US005462360A

United States Patent [19]

Tilman et al.

[11] Patent Number: 5,462,360

[45] **Date of Patent: * Oct. 31, 1995**

[54] STABILIZING WEDGE ZIPPER WITH HIGH MELT INDEX INTERLAYER

[75] Inventors: Paul A. Tilman, New City; Richmond M. Scott, Pleasantville; Zdenek Machacek, Nanuet, all of N.Y.

[73] Assignee: Minigrip, Inc., Orangeburg, N.Y.

[ * ] Notice: The portion of the term of this patent subsequent to Nov. 29, 2011, has been disclaimed.

[21] Appl. No.: 249,144

[22] Filed: May 25, 1994

Related U.S. Application Data

[63] Continuation-in-part of Ser. No. 174,273, Dec. 28, 1993, Pat. No. 5,368,394.

[51] Int. Cl.[6] ..... B65D 33/24

[52] U.S. Cl. ..... 383/63; 383/65; 24/587

[58] Field of Search ..... 383/63, 65; 24/587

[56] References Cited

U.S. PATENT DOCUMENTS

| | | | |
|---|---|---|---|
| 4,430,070 | 2/1984 | Ausnit | 493/215 |
| 4,731,911 | 3/1988 | Gould | 383/63 X |
| 4,736,496 | 4/1988 | Fisher et al. | 383/63 X |
| 4,817,188 | 3/1989 | Van Erden | 383/63 |
| 4,829,641 | 5/1989 | Williams | 383/63 X |
| 4,964,739 | 10/1990 | Branson et al. | 383/63 X |
| 5,004,356 | 4/1991 | Matsui | 383/63 |
| 5,242,516 | 9/1993 | Custer et al. | 383/63 X |
| 5,368,394 | 11/1994 | Scott et al. | 383/63 |

*Primary Examiner*—Jes F. Pascua

*Attorney, Agent, or Firm*—Kane, Dalsimer, Sullivan, Kurucz, Levy, Eisele and Richard

[57] ABSTRACT

A reclosable plastic bag is provided having a zipper with profile strips on opposed walls. The profile strips consist of male and female profiles each surrounded by stabilizing wedges with the male wedges within the female wedges. An interlayer of low temperature melt material is interposed between at least a portion of each of the profile strips and its associated wall. The interlayer may span the full width of the profile strip or only a partial width of the strips.

6 Claims, 3 Drawing Sheets

STABILIZING WEDGE ZIPPER WITH HIGH MELT INDEX INTERLAYER

CROSS-REFERENCE TO RELATED APPLICATIONS

The present application is a continuation-in-part of application Ser. No. 08/174,273 filed Dec. 28, 1993, now U.S. Pat. No. 5,368,394.

1. Field of The Invention

This invention pertains to the art of reclosable plastic bags having extruded zippers, and more particularly to a reclosable bag having fastener profiles having wedge-shaped stops, which facilitate the joining attachment of the fastener profiles and which determine the amount of pull force required to open the bags. The fastener profiles are further of a design which makes inadvertent opening of the bags less likely.

2. Description of the Prior Art

Reclosable bags used, for example, for storing household foodstuffs are typically made of polyethylene. As shown in U.S. Pat. No. 3,416,199 to Imamura commonly assigned with the present invention, a reclosable bag may be formed of two opposed walls equipped at the mouth with fastener profiles. These profiles include a male profile attached to one wall and a female profile on the other wall. The profiles are shaped so that, when they are aligned and pressed together into an engaging relationship, they form a continuous closure for the bag. The bag may be opened by pulling the walls apart thereby separating the profiles. Various geometric shapes and arrangements for such profiles are shown in U.S. Pat. Nos. Re. 28,969; 3,323,707; 4,212,337; 4,363,345; 4,561,108; and 4,812,056. In addition, U.S. Pat. Nos. 4,736,496 and 5,012,561 disclose reclosable bags with profiles and internal ribs adjacent to the profiles. U.S. Pat. No. 4,822,539 discloses a reclosable bag with interlocking profiles, internal guiding ribs disposed adjacent to the profiles, and stabilizing beams disposed on the outside surface of the bag wall. U.S. Pat. No. 3,338,285 discloses a reclosable bag having several parallel interlocking male and female profiles. In general, the profiles must be such as to provide relatively high resistance to opening from inside the bag while rendering the bag relatively easy to open from the outside.

For the zipper to function properly, it is important that the zipper components (i.e. the profiles and any wedges, beams, ribs or the like provided to enhance the operation of the profiles) maintain their alignment. The problem of maintaining the alignment of the components of the zipper is exacerbated where the zipper is in string or strip form to be heat sealed to a film material from which the body of the bag is to be formed since the heat necessary to fuse the zipper strip to the film could distort the profiles or a zipper component. Heretofore the problem has been avoided by adding webs to the zipper strip to separate the profiles (and components) from the point of attachment to the film. In U.S. Pat. No. 4,673,383 a zipper strip is disclosed having fusible ribs on its undersurface to minimize the heat to which the zipper is subjected. In U.S. Pat. Nos. 4,691,372; 4,731,911; and 4,817,188 an adhesive layer is provided on the base of the profile portion of the strip.

SUMMARY OF THE INVENTION

In view of the above, an objective of the present invention is to provide a reclosable bag with improved closure means resistant to inadvertent opening.

Another object is to provide such closure means in the form of a zipper strip which may be heat sealed to an associated film without distorting the zipper profiles or any of the components of the zipper.

Other objectives and advantages of the invention will become apparent from the following description. A reclosable bag constructed in accordance with this invention includes a front wall and a rear wall joined to form an enclosure with a mouth defined by wall edges at the top of the bag and male and female profile means having male and female members for selectively opening and closing said mouth. Stabilizer wedges are provided on each of the male and female profile means. Specifically, a stabilizer wedge is provided on each side of the male and female members on the male and female profile means. The wedges keep the zipper parallel during the application of the zipper to the film from which the bag is made and have a stabilizing effect during the attachment process. Further, the wedge action controls the force required to open the bag, and substantially increases the inside resistance to opening pressure from the product within the bag. Finally, the stabilizer provides the zipper as a whole with a widetrack feel.

The profiles are provided on zipper strips heat sealed to the front and rear walls of the bag. To facilitate the heat sealing, a layer of a material having a high EVA content is provided underlying at least a portion of the zipper strip width so that the zipper may be heat sealed to the bag walls at a temperature sufficiently low to prevent distortion of the profiles or wedges. The high EVA material may underlie only a portion of the zipper width so that a hinged connection is provided between the zipper strip and bag wall.

DETAILED DESCRIPTION OF THE PREFERRED EMBODIMENT

Figure 2:
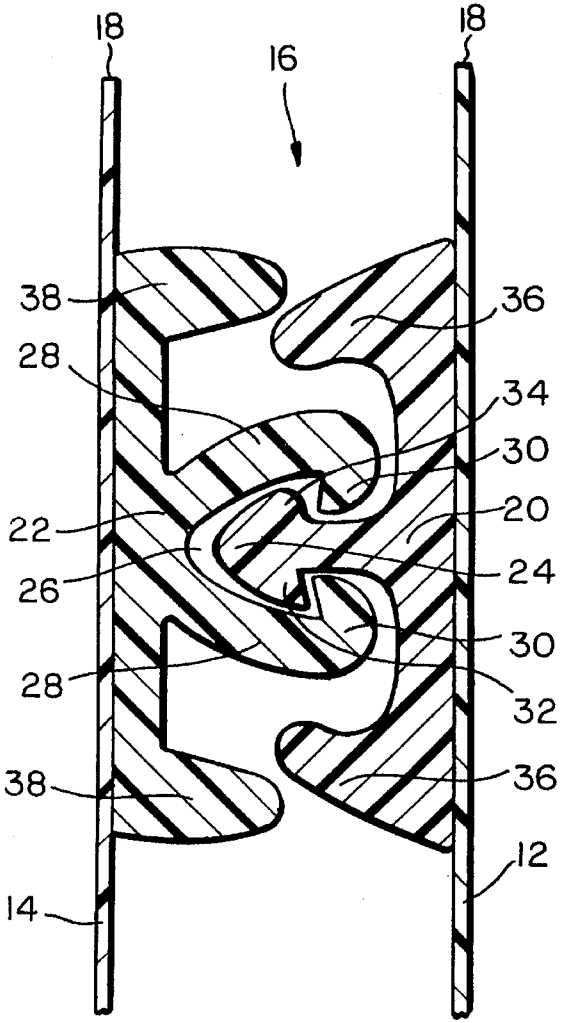
FIG. 2 shows an enlarged side sectional view of the bag opening.
Figure 1:
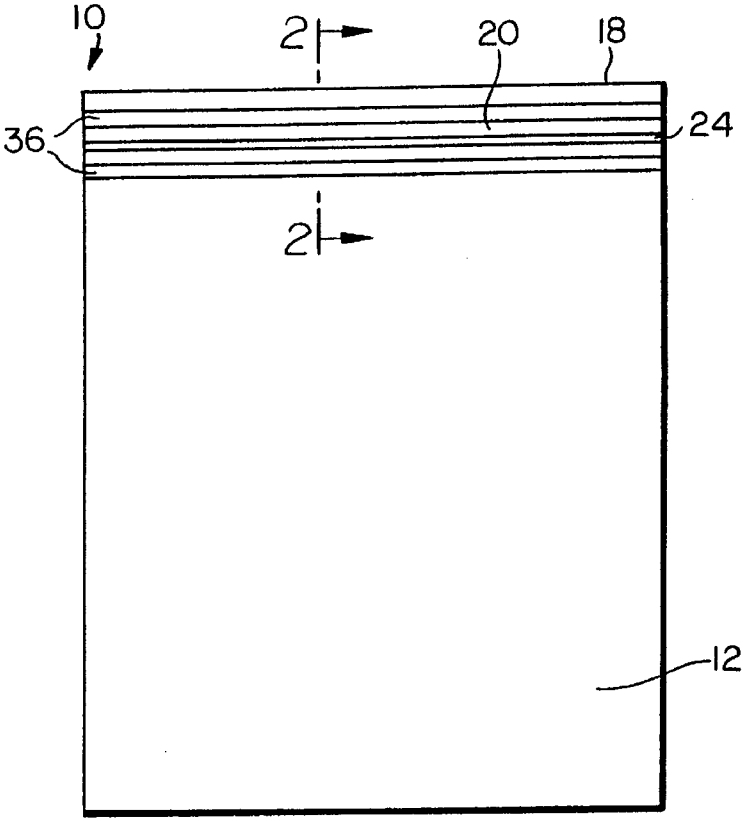
FIG. 1 shows a plan view of a reclosable bag constructed in accordance with the present invention.

Referring now to the drawings, and specifically to FIGS. 1 and 2, a reclosable bag 10 constructed in accordance with this invention includes front and rear walls 12,14 seamed along three edges thereby forming an enclosure with an opening or mouth 16 along the top or fourth edge 18. The bag 10 is preferably made of a thermoplastic material such as polyethylene by extrusion. Attached to internal faces, walls 12 and 14 are male and female profiles 20,22 respectively, which extend continuously from side to side of the bag. The profile serves to close the bag opening 16 when they are interlocked as shown in FIG. 2.

The male profile 20 includes an asymmetric arrowhead 24 which locks into a channel 26 formed by two inwardly curved members 28 having inwardly pointing stubs 30. The asymmetric arrowhead 24 is so called because its two barbs are not mirror images of one another. Barb 32 has an acute edge, while barb 34 has a rounded edge. Barb 34 is closer to the mouth 16 of the bag 10 than barb 32.

The male profile 20 has two stabilizer wedges 36, which are on each side of the asymmetric arrowhead 24 and are parallel thereto across the width of the bag 10. The stabilizer wedges 36 are inclined toward one another and toward asymmetric arrowhead 24.

In like manner, the female profile 22 has two stabilizer wedges 38, which are on each side of the inwardly curved members 28 and are parallel thereto across the width of the bag 10. The stabilizer wedges 38 are inclined away from one another, or, at least, have surfaces facing the inwardly curved members 28 which are inclined away from one another.

When the male and female profiles 20,22 are interengaged as shown in FIG. 2, stabilizer wedges 36 protrude to some preselected degree into the spaces between the stabilizer wedges 38 and the inwardly curved members 28 on the female profile 22.

Figure 3:
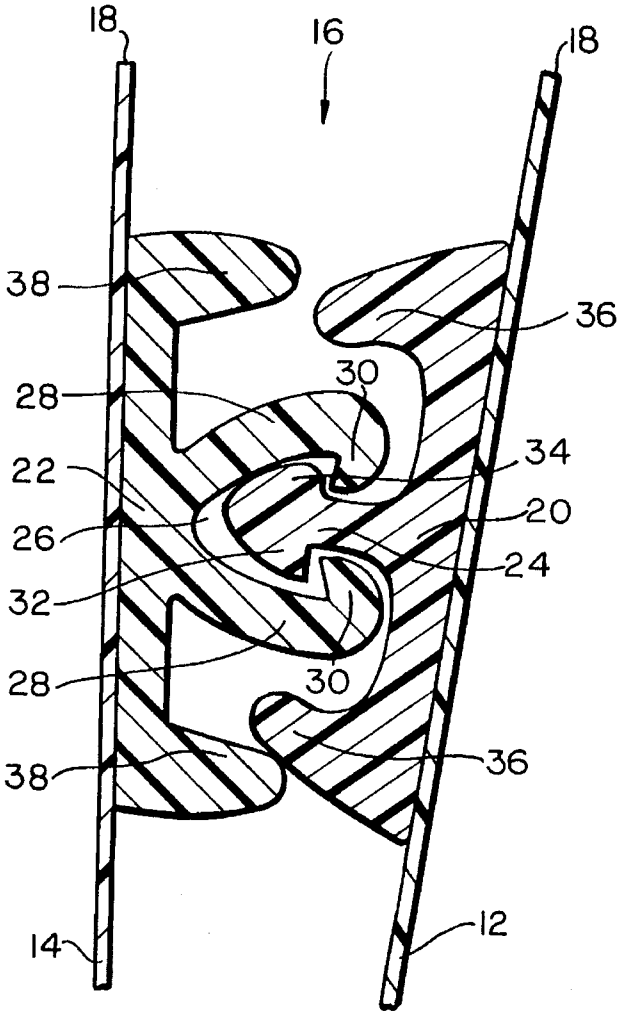
FIG. 3 shows an enlarged side sectional view, analogous to that presented in FIG. 2, of the bag being opened from the outside.

Bag 10 is normally opened by gripping edges 18 on the outside of the bag 10 and pulling them apart. In response to such action the lower stabilizer wedges 36,38, which are toward the inside of the bag 10, as shown in FIG. 3, abut against one another. This braces the male profile 20 against the female profile 22, and allows the rounded barb 34 of the asymmetric arrowhead 24 to glide past its adjacent stub 30 to open the bag 10. The force required to open the bag 10 may be preselected by appropriately choosing the angles at which the surfaces of stabilizer wedges 36,38 contact one another.

Figure 4:
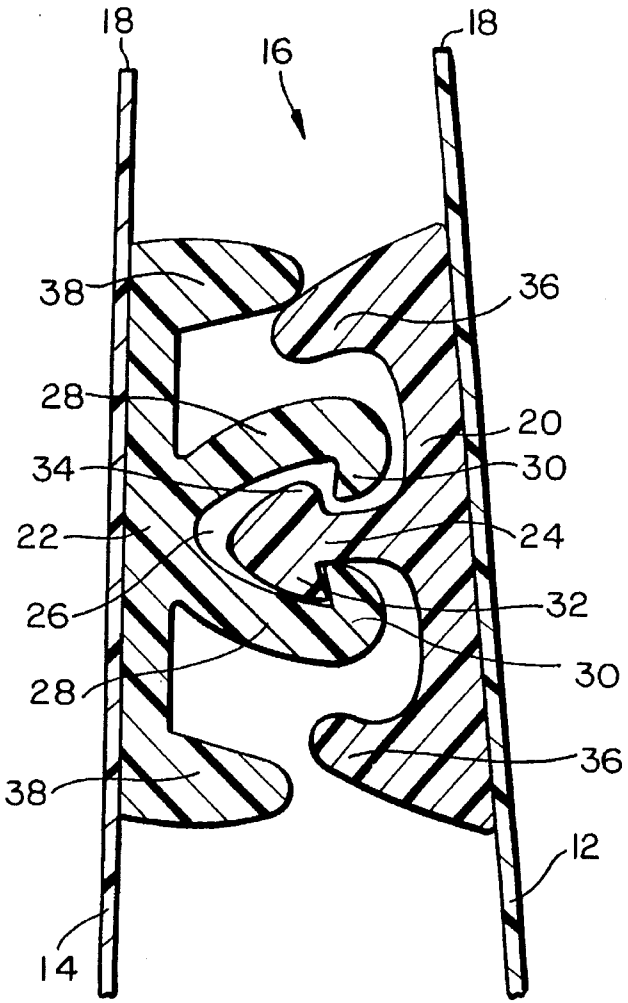
FIG. 4 shows another enlarged side sectional view, analogous to that presented in FIG. 2, of the bag being opened from the inside

The situation that would arise from an opening force from within the bag 10 is shown in FIG. 4. In response to such action, the upper stabilizer wedges 36,38, which are toward the outside of the bag 10, as shown in FIG. 4, abut against one another. This again braces the male profile 20 against the female profile 22, and hooks the acute barb 32 of the asymmetric arrowhead 24 behind its adjacent stub 30 inhibiting the opening of the bag 10. The force required to open the bag 10 from within may be preselected by appropriately choosing the angles at which the surfaces of stabilizer wedges 36,38 contact one another.

Bag 10 may be generated unitarily, for example, by extruding the walls 12,14, and the profiles 20,22 integrally. Alternatively, the closures may be extruded separately, and then may be bonded to sheets of bag forming material at some stage in the bag forming operation.

Figure 5:
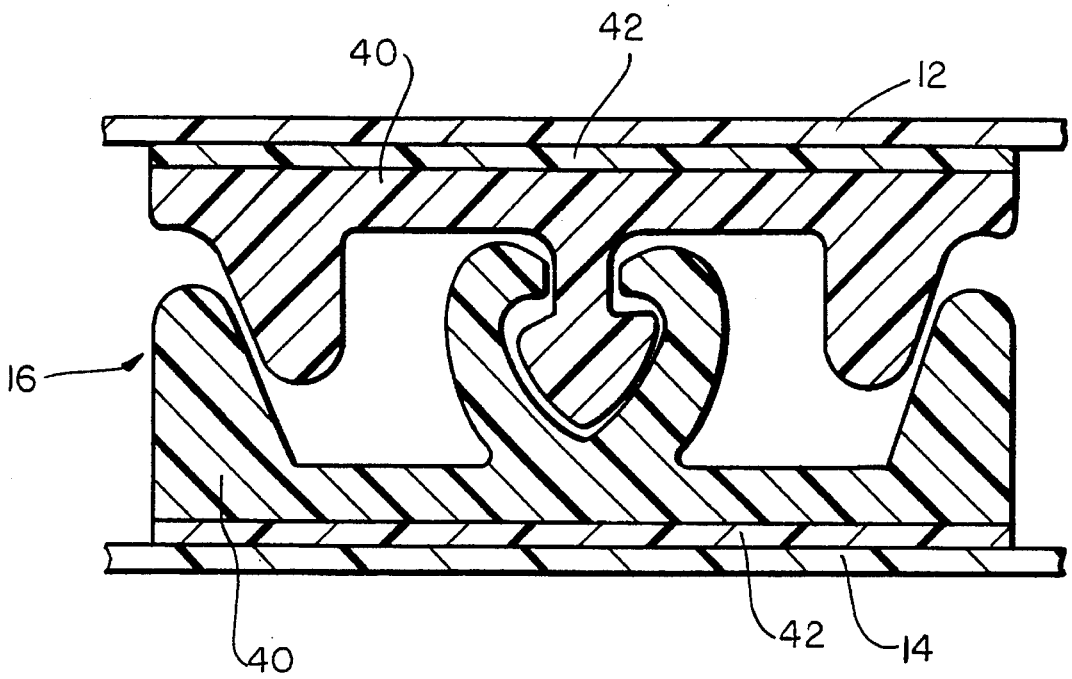
FIG. 5 shows an enlarged side sectional view of an alternative embodiment of the bag of the present invention wherein an interlayer is utilized between the bag walls and profile strips.
Figure 6:
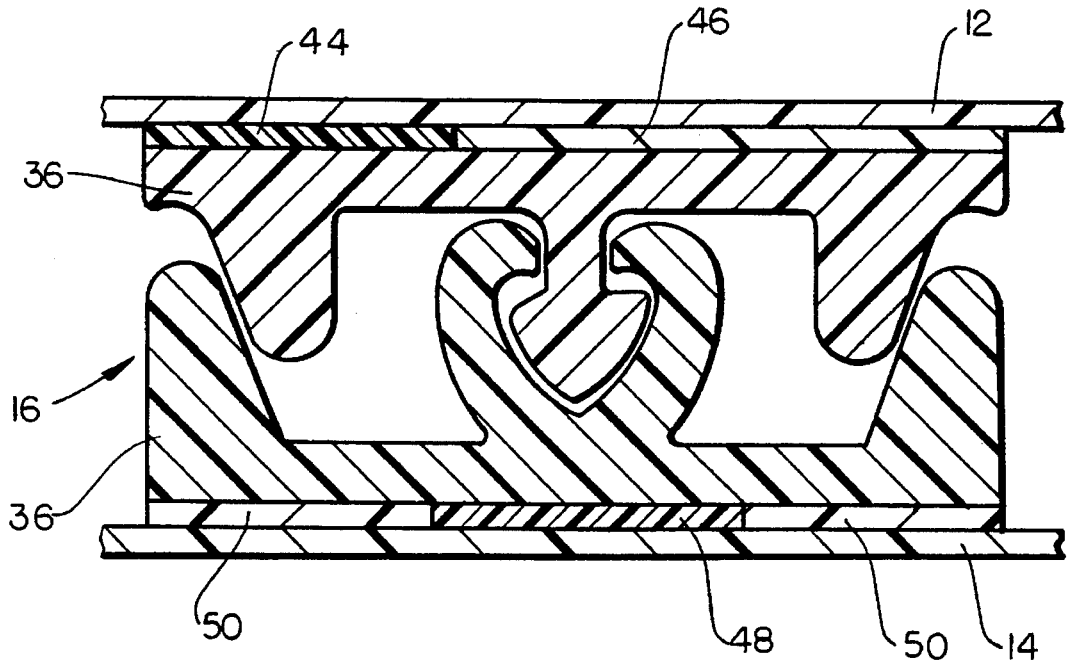
FIG. 6 shows an enlarged side sectional view of a further embodiment of the bag of the present invention.

The construction of the zippers shown in FIGS. 5 and 6 is the same as that described above except that in each case an intermediate layer 42 is provided between the base 40 of the profile strips and the bag walls 10, 12. The intermediate layer comprises, at least in part, a material having a lower melt temperature than the base of the profile strip and a higher EVA content. Thus, in FIG. 5, the zipper may be formed of a relatively low melt index material, such as a conventional polyethylene, whereas the intermediate layer 42 may be formed of a high EVA content polyethylene or may be provided of a relatively high melt index polyethylene material such sold by Quantum Chemical Co. under the tradename NATR 201. The melt index of the latter being 6 as compared with a melt index of 2 for the conventional polyethylene resin from which the zipper is formed.

In the embodiment of FIG. 6, on the male profile side of the zipper the high EVA material 44 of the interlayer is provided behind only a portion of the zipper carrying the male profile. The high EVA material 44 extends downwardly (i.e. toward the bag bottom) from the top edge of the zipper substantially behind the top wedge 36. The lower portion 46 of the interlayer (i.e. behind the male profile and bottom wedge) is formed of a non-seal material (i.e. a material that will not fuse to the bag wall at the temperature at which the top portion 44 of the interlayer is fused to the bag wall). As a result the male profile strip will be hinged to the bag wall to enhance the resistance to opening of the bag from within the bag in the manner described in U.S. Pat. No. 4,430,070. The high EVA material 48 of the female profile strip is disposed behind the female profile and strips 50 formed of non-seal material are provided above and below the female profile as shown.

Obviously, numerous modifications may be made to this invention without departing from its scope as defined in the appended claims.

What is claimed is:

1. A reclosable bag comprising:

a first wall and a second wall joined to form an enclosure with a mouth defined by wall edges;

a zipper for selectively opening and sealing said mouth, said zipper comprising a male profile strip extending along an internal surface of said first wall and a female profile strip adapted to interengage with said male profile and extending along an internal surface of said second wall, said male profile strip includes a first stabilizer wedge on one side thereof and parallel thereto, and a second stabilizer wedge on the other side thereof and parallel thereto across said bag, said female profile strip includes a first stabilizer wedge on one side thereof and parallel thereto, and a second stabilizer wedge on the other side thereof and parallel thereto across said bag, said first and second stabilizer wedges of said male profile being inward of said first and second stabilizer wedges of said female profile with respect to said male and female profiles, when said male and female profiles are aligned to be interengaged, and an interlayer disposed between at least a portion of one of said profile strips and its associated wall, said interlayer being formed at least in part of a strip of material extending parallel to said profiles which forms an adhesive bond with said wall at a lower temperature than a melt temperature of said at least one profile strip.

2. The reclosable plastic bag in accordance with claim 1 wherein interlayers of material having lower adhesive bonding temperatures than a melt temperature of said profile strips are provided between both of said profile strips and their associated walls.

3. The reclosable plastic bag in accordance with claim 1 wherein an interlayer is disposed between each of said profile strips and its associated wall and each of said interlayers is formed only in part of a strip of material extending parallel to said profiles and having a lower adhesive bonding temperature than a melt temperature of said profile strips, said strips of lower bonding temperature material being coextensive with less than the full width of their associated profile strips.

4. The reclosable plastic bag in accordance with claim 3 wherein the strip of lower adhesive bonding temperature material of the interlayer between said male profile strip and its associated wall extends downwardly from the top of said male profile strip for less than the full width of said male profile strip substantially disposed behind one of said stabilizer wedges.

5. The reclosable plastic bag in accordance with claim 3 wherein the lower adhesive bonding temperature material of the interlayer between said female profile strip and its associated wall is substantially disposed only behind said female profile and neither of said stabilizer wedges.

6. The reclosable plastic bag in accordance with claim 1 wherein said interlayer is formed of an EVA material.

* * * * *